US006862891B2

(12) United States Patent
Devos

(10) Patent No.: US 6,862,891 B2
(45) Date of Patent: Mar. 8, 2005

(54) METHODS AND APPARATUS FOR CONTROLLING HEATING WITHIN REFRIGERATORS

(75) Inventor: Richard Devos, Goshen, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/452,463

(22) Filed: Jun. 2, 2003

(65) Prior Publication Data

US 2004/0237568 A1 Dec. 2, 2004

(51) Int. Cl.[7] ..... F25D 21/08
(52) U.S. Cl. ..... 62/80; 62/344; 62/275
(58) Field of Search ..... 62/275, 344

(56) References Cited

U.S. PATENT DOCUMENTS 3,934,691 A 1/1976 Toloczko
4,209,999 A 7/1980 Falk et al.
4,285,212 A 8/1981 Prada
4,332,142 A 6/1982 Prada
4,333,588 A 6/1982 Schreck et al.
4,474,017 A 10/1984 Prada
4,735,062 A 4/1988 Wooley et al.
4,881,315 A 11/1989 Powell et al.
5,269,154 A 12/1993 Schmidt
5,442,933 A 8/1995 Unger
5,638,694 A 6/1997 Banicevic
5,725,294 A 3/1998 Froelicher
6,301,913 B1 10/2001 Schulak et al.
6,533,003 B1 3/2003 Jacobus et al.

*Primary Examiner*—William E. Tapolcai
(74) *Attorney, Agent, or Firm*—H. Neil Houser, Esq.; Armstrong Teasdale LLP

(57) ABSTRACT

A refrigerator is provided. The refrigerator includes a freezer compartment having a freezer door, an ice maker in communication with an ice dispensing system, the ice dispensing system has an ice delivery conduit extending through the freezer door, and a heating element positioned proximate to the ice dispensing system to provide heat to the ice dispensing conduit. The refrigerator further includes a controller operationally coupled to the heating element, the controller providing variable wattage to the heating element.

27 Claims, 2 Drawing Sheets

METHODS AND APPARATUS FOR CONTROLLING HEATING WITHIN REFRIGERATORS

BACKGROUND OF THE INVENTION

This invention relates generally to refrigerators, and more particularly, to controlling heating within such refrigerators.

Some known refrigerators include a fresh food compartment and a freezer compartment. Such a refrigerator also typically includes a refrigeration circuit including a compressor, evaporator, and condenser connected in series. An evaporator fan is provided to blow air over the evaporator, and a condenser fan is provided to blow air over the condenser. In operation, when an upper temperature limit is reached in the freezer compartment, the compressor, evaporator fan, and condenser fan are energized. Once the temperature in the freezer compartment reaches a lower temperature limit, the compressor, evaporator fan, and condenser fan are de-energized.

An ice maker may be located in the freezer compartment and operable to make ice cubes. A through-the-door ice and water dispenser may be provided to deliver ice and water to a user without the user opening the refrigerator doors. Known through the door ice dispensers include a front opening in an ice chute through which ice is dispensed. Ice dispensers typically have a duct door covering the front opening that prevents warm moist air from entering the refrigerator compartment. With such an ice dispensing apparatus, it is possible that external sweating, i.e., moisture or condensation, will appear in the ice dispenser area under high temperature or high humidity conditions. This sweating results from the relatively low temperature inside the chute and the ambient conditions to which the duct door is exposed.

Sweating has been reduced by applying heat to the areas likely to be affected by condensation. In some refrigerators this is accomplished by an electric heater positioned adjacent to the ice dispenser apparatus area. Similar heaters are positioned inside the ice dispenser apparatus or connected directly to the duct door. In other refrigerators, a hot gas loop is positioned inside the front face of the cabinet.

Electric heaters may not have an expected life as long as the refrigerator. Thus, a manufacturer may install two heaters, with the second to be used only if the first becomes inoperable. This increases the cost of all such refrigerators when only a small percentage of the second heaters will ever be needed. The use of electric heat facilitate reducing or preventing sweating requires additional energy from the refrigerator to supply the wattage to the electric heater to overcome sweating, thereby increasing energy costs. However, refrigerators must comply with government regulations with regard to energy usage. In order to comply, known refrigerators must decrease the amount of energy supplied to the electric heater resulting in decreased electric heater performance and an increase in sweating of the ice dispenser apparatus area and door duct.

BRIEF DESCRIPTION OF THE INVENTION

In one aspect, a refrigerator is provided. The refrigerator includes a freezer compartment having a freezer door, an ice maker in communication with an ice dispensing system, the ice dispensing system has an ice delivery conduit extending through the freezer door, and a heating element positioned proximate to the ice dispensing system to provide heat to the ice dispensing conduit. The refrigerator further includes a controller operationally coupled to the heating element, the controller providing variable wattage to the heating element.

In another aspect, an ice dispensing system for a freezer compartment of a refrigerator is provided. The freezer compartment has an ice maker and a freezer door. The ice dispensing system includes a dispensing conduit extending through the freezer door, the ice dispensing conduit is in communication with the ice maker, so as to pass ice through the freezer door, an ice dispensing conduit door is positioned proximate to the dispensing conduit, the conduit door is moveable between an open position and a closed position, a heating element positioned adjacent to the ice dispensing conduit door providing heat to the ice dispensing conduit door, and a controller operationally coupled to the heating element, the controller configured to modulate wattage to the heating element.

In a further aspect, a method for facilitating reduction of condensation on an ice dispensing apparatus of a refrigerator is provided. The method includes providing a heating element adjacent to the ice dispensing apparatus, and modulating a wattage supplied to the heating element.

DETAILED DESCRIPTION OF THE INVENTION

Figure 1:
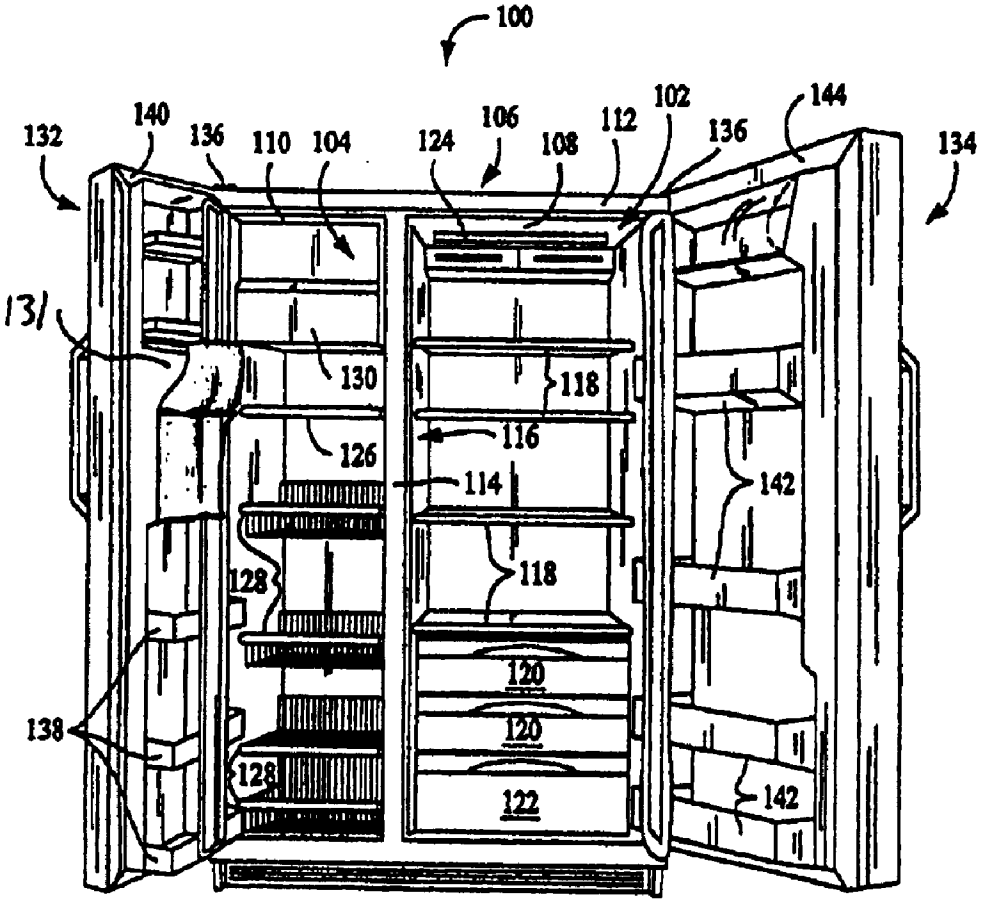
FIG. 1 is a perspective view of an exemplary refrigerator.

FIG. 1 is a perspective view of an exemplary refrigerator 100 in which exemplary embodiments of the present invention may be practiced and for which the benefits of the invention may be realized. It is appreciated, however, that the herein described methods and apparatus may likewise be practiced in a variety of alternative refrigerators with modification apparent to those in the art. Therefore, refrigerator 100 as described and illustrated herein is for illustrative purposes only and is not intended to limit the herein described methods and apparatus in any aspect.

FIG. 1 illustrates a side-by-side refrigerator 100 including a fresh food storage compartment 102 and freezer storage compartment 104. Freezer compartment 104 and fresh food compartment 102 are arranged side-by-side. In one embodiment, refrigerator 100 is a commercially available refrigerator from General Electric Company, Appliance Park, Louisville, Ky. 40225, and is modified to incorporate the herein described methods and apparatus.

It is contemplated, however, that the teaching of the description set forth below is applicable to other types of refrigeration appliances, including but not limited to top and bottom mount refrigerators wherein undesirable temperature gradients exist. The herein described methods and apparatus is therefore not intended to be limited to any particular type or configuration of a refrigerator, such as refrigerator 100.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 may partly form a quick chill and thaw system (not shown) and selectively controlled, together with other refrigerator features, by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104.

Freezer compartment 104 includes an automatic ice maker 130 and a dispenser 131 is provided in freezer door 132 so that ice can be obtained without opening freezer door 132. As will become evident below, ice maker 130, in accordance with conventional ice makers includes a number of electromechanical elements that manipulate a mold to shape ice as it freezes, a mechanism to remove or release frozen ice from the mold, and a primary ice bucket for storage of ice produced in the mold. Periodically, the ice supply is replenished by ice maker 130 as ice is removed from the primary ice bucket. The storage capacity of the primary ice bucket is generally sufficient for normal use of refrigerator 100.

Freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator subject to the following control scheme.

Figure 2:
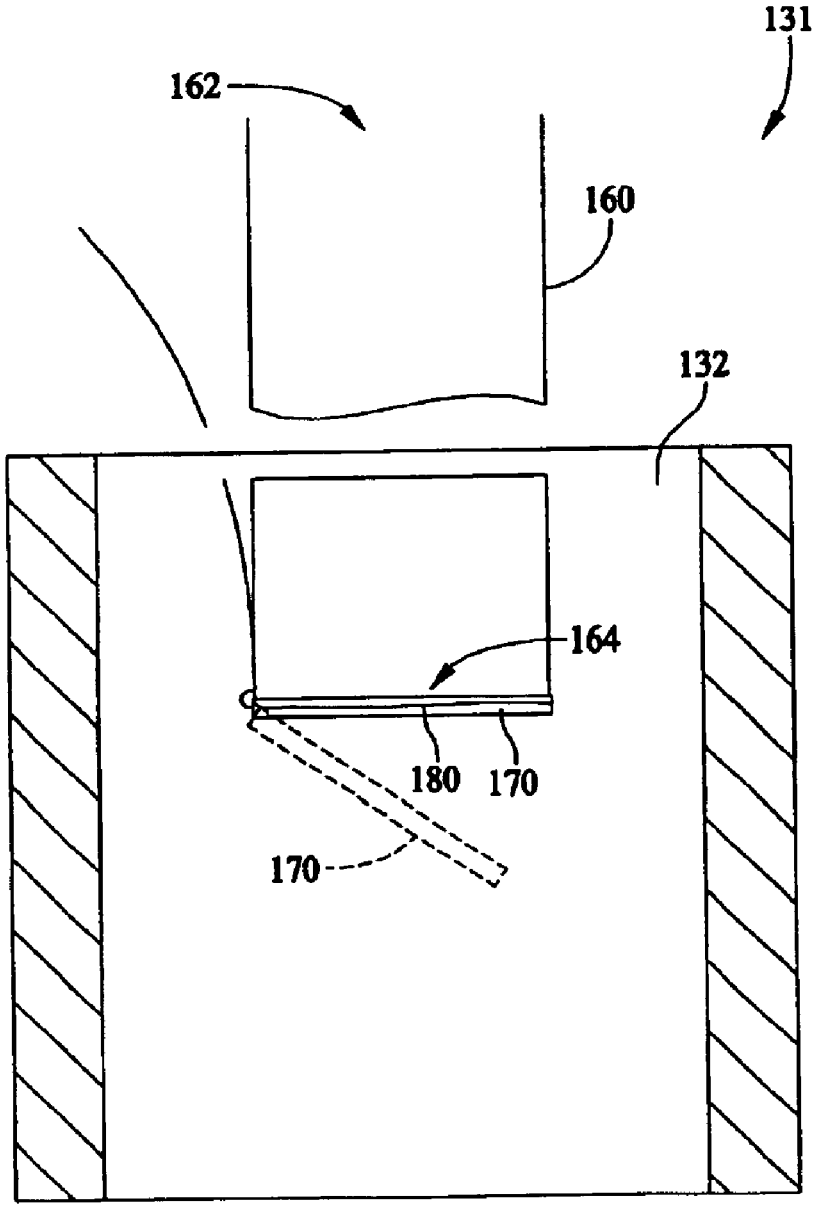
FIG. 2 is a front view of an exemplary ice dispensing apparatus.

FIG. 2 is a front view of one embodiment of ice dispenser 131. Ice dispenser 131 includes an ice-discharge conduit or chute 160 passing through freezer door 132. Chute 160 has an inlet 162 for receiving ice from ice maker 130 and an outlet 164 for delivering ice to a user. Chute 160 extends through freezer door 132 in a downward direction for gravitational movement of the ice through chute 160.

A closure, such as a duct door 170, is mounted forwardly of outlet 164. Duct door 170 is movable between an open position (shown in phantom lines), which permits ice to discharge through outlet 164 and a closed position, which seals chute 160. The position of duct door 170 is controlled by an actuator (not shown) to maintain duct door in the second position when ice dispenser 131 is not in operation. The particular mounting structure, duct door, and actuating mechanism may take many known forms.

A heating element 180 is coupled to duct door 170 to facilitate reducing or preventing sweating of duct door 170. In one embodiment, heating element 180 is an electrical resistance wire, as is known in the art, and is embedded in or attached to duct door 170. In another embodiment, heating element 180 is adjacent to duct door 170 facilitate reducing or preventing sweating of duct door 170 and chute 160. In a further embodiment, heating element 180 is proximate to duct door 170, so as so provide sufficient amount of heat facilitate reducing or preventing sweating in and around the ice dispenser 131 area.

A controller (not shown), such as a microprocessor, controls the operation of the refrigerator by directing energy to the various electrical components of refrigerator 100. The controller modulates the wattage to heating element 180 by various means. This allows use of a single heating element 180 for the reduction or prevention of sweating. Thus, the controller provides variable wattage to different components of refrigerator 100 as needed. For example, if heating element 180 does not require energy and refrigerator 100 needs to cool the air inside fresh food compartment 102, the controller can direct power away from heating element 180 and send power to the vapor compressor cycle components. If sweating occurs, controller directs enough wattage to heating element 180 to eliminate sweating. Modulation of wattage to heating element 180 avoids the shortcomings of known heating elements which are limited in wattage usage due to energy restrictions. The modulation of wattage to heating element 180 allows for an increased amount of wattage to heating element 180, such as, for example, ten watts, to eliminate sweating without exceeding energy usage restrictions.

In one embodiment, the controller modulates wattage to heating element 180 based on duty cycles. More specifically, the amount of wattage supplied to heating element 180 is almost directly proportional to the percentage of the duty cycle for heating element 180. In another embodiment, the controller modulates wattage to heating element 180 by applied voltage.

In another embodiment, the controller modulates wattage to heating element 180 based on the size of refrigerator 100. In another embodiment, heating element 180 is modular and capable of being incorporated into a variety of differently sized refrigerators. The controller provides variable wattage to heating element 180 based on the size of the refrigerator. In other words, a first refrigerator and a second refrigerator sized different than the first refrigerator both have the same heater. The heater in the first refrigerator is controlled at a wattage different than that of the second heater.

In another embodiment, the controller provides variable wattage to heating element 180 based on the frequency of use of the ice dispenser. In another embodiment, the controller provides variable wattage to heating element 180 based on the frequency of ice harvest within ice maker 130. In another embodiment, the controller provides variable wattage to heating element based on a user defined control setting. In another embodiment, the controller provides variable wattage to heating element 180 based on the run times of refrigerator 100, such as the run time of the compressor. In another embodiment, the controller applies a specific wattage to heater element 180 as part of a service fix. For example, when a refrigerator requires servicing from a repair person, the repair person may set a specific wattage for heater element 180.

In another embodiment, the controller provides variable wattage based on a humidity sensor (not shown). In a further embodiment, the controller provides variable wattage to the heating element 180 based on temperature of the freezer compartment 104.

The modulation of wattage permits the use of only one heating element to reduce or eliminate sweating, thereby reducing cost. Additionally, the same single heating element can be provided to different refrigerators, thereby further reducing part number and costs.

While the invention has been described in terms of various specific embodiments, those skilled in the art will recognize that the invention can be practiced with modification within the spirit and scope of the claims.

What is claimed is:

1. A refrigerator comprising:

a freezer compartment including a freezer door;

an ice maker positioned within said compartment, said ice maker in communication with an ice dispensing system comprising an ice delivery conduit extending through said freezer door;

a heating element positioned proximate to said ice dispensing system to provide heat to said ice dispensing conduit; and a controller operationally coupled to said heating element, said controller configured to provide variable wattage to said heating element during operation such that said controller changes the wattage between a first non-zero wattage and a second non-zero wattage based upon a predetermined occurrence.

2. A refrigerator according to claim 1 wherein said heating element is coupled to said ice delivery conduit.

3. An ice dispensing system for a freezer compartment having an ice maker and a freezer door, said ice dispensing system comprising:

a dispensing conduit extending through the freezer door, said dispensing conduit in communication with the ice maker, so as to pass ice through the freezer door;

an ice dispensing conduit door positioned proximate said conduit, said door moveable between an open position and a closed position;

a heating element positioned adjacent to said ice dispensing conduit door providing heat to said ice dispensing conduit door; and a controller operationally coupled to said heating element, said controller configured to modulate wattage to said heating element between a first non-zero wattage and a second non-zero wattage based upon a predetermined occurrence.

4. An ice dispensing system according to claim 3 wherein said controller is further configured to modulate the wattage to said heating element based on a duty cycle for said heating element.

5. An ice dispensing system according to claim 3 wherein said controller is further configured to modulate the wattage to said heating element by applied voltage.

6. An ice dispensing system according to claim 3 wherein said controller is further configured to modulate the wattage to said heating element based on the size of the refrigerator.

7. An ice dispensing system according to claim 6 wherein said heating element is modular.

8. An ice dispensing system according to claim 3 wherein said controller is further configured to modulate the wattage to said heating element based on the frequency of operation of the ice maker.

9. An ice dispensing system according to claim 3 wherein said controller is further configured to modulate the wattage to said heating element based on the frequency of an ice harvest in said ice maker.

10. An ice dispensing system according to claim 3 wherein said controller is further configured to modulate the wattage to said heating element based on a control setting.

11. An ice dispensing system according to claim 3 wherein said controller is further configured to modulate the wattage to said heating element based on the run time of the refrigerator.

12. An ice dispensing system according to claim 3 wherein said controller is configured to apply a specific wattage to said heating element as part of a service fix.

13. An ice dispensing system according to claim 3 wherein said controller is further configured to modulate the wattage to said heating element based on a humidity sensor.

14. An ice dispensing system according to claim 3 wherein said controller is further configured to modulate the wattage to said heating element based on a temperature of the freezer compartment.

15. A method for facilitating a reduction of condensation on an ice dispensing apparatus of a refrigerator, said method comprising:

providing a heating element adjacent to the ice dispensing apparatus; and modulating a wattage supplied to the heating element between a first non-zero wattage and a second non-zero wattage based upon a predetermined occurrence.

16. The method according to claim 15 wherein providing a heating element adjacent to the ice dispensing apparatus further comprises coupling the heating element to the ice dispensing apparatus.

17. The method according to claim 15 wherein modulating a wattage supplied to the heating element further comprises modulating a wattage to the heating element by a duty cycle of the heating element.

18. The method according to claim 15 wherein modulating a wattage to the heating element further comprises modulating a wattage to the heating element by applied voltage.

19. The method according to claim 15 wherein modulating a wattage to the heating element further comprises modulating a wattage to the heating element based on a size of the refrigerator.

20. The method according to claim 19 wherein providing a heating element further comprises providing a modular heating element.

21. The method according to claim 15 wherein modulating a wattage to the heating element further comprises modulating a wattage to the heating element based on the frequency of operation of the ice dispensing apparatus.

22. The method according to claim 15 wherein modulating a wattage to the heating element further comprises modulating a wattage to the heating element based on the frequency of an ice harvest of the ice dispensing apparatus.

23. The method according to claim 15 wherein modulating a wattage to the heating element further comprises modulating a wattage to the heating element based on a control setting.

24. The method according to claim 15 wherein modulating a wattage to the heating element further comprises modulating a wattage to the heating element based on a run time of the refrigerator.

25. The method according to claim 15 wherein modulating a wattage supplied to the heating element further comprises applying a specific wattage to the heating element as part of a service fix.

26. The method according to claim 15 wherein modulating a wattage to the heating element further comprises modulating a wattage to the heating element based on a humidity sensor.

27. The method according to claim 15 wherein modulating a wattage to the heating element further comprises modulating a wattage to the heating element based on a temperature of the refrigerator.

* * * * *